US006162769A

United States Patent [19]

Polhaar et al.

[11] Patent Number: 6,162,769

[45] Date of Patent: Dec. 19, 2000

[54] LUBRICATING OIL COMPOSITIONS SUITABLE FOR USE IN MEDIUM SPEED DIESEL ENGINES

[75] Inventors: Gerardus J. E. Polhaar, Rotterdam; Dick J. E. Vrolijk, Kruisland, both of Netherlands

[73] Assignee: B.V. Chevron Centrale Laboratoria, Rotterdam, Netherlands

[21] Appl. No.: 09/274,631

[22] Filed: Mar. 23, 1999

[30] Foreign Application Priority Data

Mar. 26, 1998 [EP] European Pat. Off. ..... 98302333

[51] Int. Cl.[7] ..... C10M 141/02; C10M 141/08

[52] U.S. Cl. ..... 508/339; 508/460; 508/574

[58] Field of Search ..... 508/333, 339, 508/460, 574

[56] References Cited

U.S. PATENT DOCUMENTS

| | | | |
|---|---|---|---|
| 4,948,522 | 8/1990 | Dunn et al. | 252/32.7 E |
| 5,162,085 | 11/1992 | Cane et al. | 508/460 |
| 5,397,484 | 3/1995 | Cane et al. | 508/460 |
| 5,492,638 | 2/1996 | Wallace et al. | 508/460 |
| 5,691,283 | 11/1997 | Poat et al. | 508/460 |
| 5,714,443 | 2/1998 | Cane et al. | 508/460 |
| 5,716,912 | 2/1998 | Harrison et al. | 508/192 |
| 5,716,914 | 2/1998 | Cane et al. | 508/460 |
| 5,728,657 | 3/1998 | Campbell et al. | 508/460 |
| 5,792,735 | 8/1998 | Cook et al. | 508/460 |
| 5,942,476 | 8/1999 | Campbell | 508/460 |

FOREIGN PATENT DOCUMENTS

| | | | |
|---|---|---|---|
| WO 96/20265 | 7/1996 | WIPO | C10M 159/22 |

*Primary Examiner*—Jacqueline V. Howard
*Attorney, Agent, or Firm*—Walter L. Stumpf; Richard J. Sheridan

[57] ABSTRACT

A lubricating oil composition reduces the adverse effects of oxidation in a medium speed diesel engine. That lubricating oil composition has a major amount of a base oil of lubricating viscosity, from 1% to 30% of a highly overbased oil-soluble sulfurized alkaline earth metal hydrocarbyl phenate-carboxylate and from 0.1% to 5% of a polyalkylene succinimide prepared by reacting under reactive conditions a mixture of an alkenyl or alkylsuccinic acid derivative, an unsaturated acidic reagent copolymer of an unsaturated acidic reagent and an olefin, and a polyamine. When that lubricating oil composition has 0.1% to 2% of a physical mixture of from 20% to 90% of a zinc dialkyldithiophosphate derived from only primary alkyl alcohols, and from 10% to 80% of a zinc dialkyldithiophosphate derived from only secondary alkyl alcohols, the lubricating oil composition is useful for increasing the water tolerance of a medium speed diesel engine that are susceptible to water contamination.

17 Claims, No Drawings

LUBRICATING OIL COMPOSITIONS SUITABLE FOR USE IN MEDIUM SPEED DIESEL ENGINES

The present invention relates to lubricating oil compositions and concentrates thereof suitable for use in medium speed diesel engines.

BACKGROUND OF THE INVENTION

Medium-speed diesel engines are used in applications where thousands of horsepower (up to 32,000) are needed. This includes propulsion engines of deep-draft, sea-going vessels, workboats operating in the inland and coastal waterways, and stand-by or continuous electrical power generation for a variety of applications including offshore drilling platforms and industrial facilities and buildings. Typically, these engines run at a speed of about 300 to 1,200 rpm.

The main lubricant for a diesel engine generally is composed of several chemical products, together with base oil of lubricating viscosity. Amongst other things, the oil should control the deposit on moving parts due to oxidation, reduce depletion of Base Number due to oxidation, and control viscosity increases due to oxidation. In addition, it should remain stable when contaminated with water, and be able to separate water easily.

A typical engine lubricating oil formulation might consist of phenate and sulfonate detergents, ashless succinimide dispersants, anti-oxidants, zinc dithiophosphates, foam inhibitors, and anti-rust agents. Sometimes, the phenate and sulfonate detergents have been replaced with salicylates to improve performance.

Because of the relatively high cost of salicylates versus phenates, it is desirable to develop a less expensive alternative to salicylates that give better performance than current phenates.

The modification of phenates with carboxylic acids or derivatives is taught in U.S. Pat. Nos. 5,714,443; 5,716,914; and 5,728,657.

U.S. Pat. No. 5,716,912 discloses a polyalkylene succinimide formed by reaction of a mixture of an alkenyl or alkylsuccinic acid derivative, an unsaturated acidic reagent copolymer of an unsaturated acidic reagent and an olefin, and a polyamine.

U.S. Pat. No. 4,948,522 discloses use of zinc dialkyldithiophosphates derived from mixtures of primary and secondary alcohols for marine applications. WO Application 96/20265 discloses use of physical mixtures of primary and secondary zinc dithiophosphates in motor car engine oils.

SUMMARY OF THE INVENTION

The present invention provides a lubricating oil composition suitable for use in medium speed diesel engines, that is particularly suited for reducing the adverse effects of oxidation of the lubricating oil composition (such as deposits, viscosity increases and BN depletion). This lubricating oil composition has:

(a) a major amount of a base oil of lubricating viscosity (b) from 1% to 30% of a modified oil-soluble sulfurized alkaline earth metal hydrocarbyl phenate, and (c) from 0.1% to 5% of a polyalkylene succinimide formed by reaction of a mixture of an alkenyl or alkylsuccinic acid derivative, an unsaturated acidic reagent copolymer of an unsaturated acidic reagent and an olefin, and a polyamine.

In the present invention, a better lubricating oil composition formulation is obtained by using a modified hydrocarbyl phenate instead of a conventional phenate and by using an improved polyalkylene succinimide instead of a conventional polyalkylene succinimide. This lubricating oil composition formulation gives better protection from the adverse effects of oxidation of the lubricating oil composition than conventional phenates and ashless dispersants. Replacing both the conventional phenate and the conventional polyalkylene succinimide gives better results than replacing only one of them.

The modified hydrocarbyl phenate component of the lubricating oil composition contains an oil-soluble sulfurized alkaline earth metal hydrocarbyl phenate that is modified by incorporation of from 2% to 40% of at least one of the following:

(1) carboxylic acid or anhydride, acid chloride or ester thereof;

(2) dicarboxylic acid or anhydride, acid chloride or ester thereof; and (3) polycarboxylic acid or anhydride, acid chloride or ester thereof.

That modified hydrocarbyl phenate component is overbased sufficiently to have a BN of at least 225 milligrams of KOH/gram.

Preferably, the modified alkaline earth metal hydrocarbyl phenate is an oil-soluble sulfurized calcium alkylphenate modified by incorporation of from 12% to 22% of carboxylic acid. The alkyl group of that alkylphenate has from 9 to 20 carbon atoms. More preferably, the carboxylic acid is stearic acid.

The polyalkylene succinimide is prepared by reacting a specific mixture under reactive conditions. That mixture comprises an alkenyl or alkylsuccinic acid derivative, an unsaturated acidic reagent copolymer of an unsaturated acidic reagent and an olefin, and a polyamine. Preferably, the mixture contains from 0.4 to 0.6 equivalents of the polyamine per equivalent of alkenyl or alkylsuccinic acid derivative plus unsaturated acidic reagent copolymer.

Preferably, the alkenyl or alkyl substituent of the alkenyl or alkylsuccinic acid derivative has a Mn of from 1800 to 3000. More preferably, the alkenyl or alkylsuccinic acid derivative is derived from polybutenes having a number average molecular weight of from 2000 to 2400.

Preferably, the copolymer has a Mn of from 2000 to 4800. Preferably, the unsaturated acidic reagent of that copolymer is maleic anhydride and the olefin of that copolymer has an average of from 12 to 28 carbon atoms.

Preferably, the polyamine has at least three nitrogen atoms and from 4 to 20 carbon atoms.

Preferably, the polyalkylene succinimide is post-treated with a cyclic carbonate or a linear mono- or poly-carbonate under reactive conditions. Most preferably, the polyalkylene succinimide is post-treated with ethylene carbonate.

Depending upon the type of application used, the lubricating oil composition can further comprise from 0.1% to 2% of at least one zinc dithiophosphate wear-inhibition additive. That zinc dithiophosphate wear-inhibition additive is useful in deep-draft, sea-going vessels, workboats and stand-by or continuous electrical power generation, but might not be useful in locomotives that require zinc-free lubricating oil compositions. The zinc dithiophosphate wear-inhibition additive can be a zinc dialkyldithiophosphate derived from primary alcohols.

The adverse effects of oxidation in a medium speed diesel engine can be reduced by lubricating the speed diesel engine with the lubricating oil composition of the present invention.

In a further embodiment, the water tolerance of medium speed diesel engines, which are susceptible to water contamination, can be increased by lubricating the medium speed diesel engine with the lubricating oil composition of the present invention that contains from 0.1% to 2% of a particular zinc dithiophosphate wear-inhibition additive. That additive is a physical mixture of from 20% to 90% of a zinc dialkyldithiophosphate derived from only primary alkyl alcohols, and from 10% to 80% of a zinc dialkyl-dithiophosphate derived from only secondary alkyl alcohols. Preferably the wear-inhibition additive is a physical mixture of from 40% to 80% of a zinc dialkyldithiophosphate derived from only primary alkyl alcohols and from 20% to 60% of a zinc dialkyldithiophosphate derived from only secondary alkyl alcohols, wherein all of the alkyl groups of all the zinc dialkyl-dithiophosphates have from three to twenty carbon atoms. Most preferably, the wear-inhibition additive is a physical mixture of from 40% to 80% of a zinc dialkyl-dithiophosphate derived from 2-ethylhexanol, from 20% to 60% of a zinc dialkyldithiophosphate derived from a mixture of 2-butanol and 4-methyl-2-pentanol.

DETAILED DESCRIPTION OF THE INVENTION

In its broadest aspect, the present invention involves an engine lubricating oil suitable for use in medium-speed diesel engines that offers improvements in controlling oxidative BN depletion and oxidative viscosity increase. That engine lubricating oil comprises a base oil of lubricating viscosity, an overbased hydrocarbyl phenate-carboxylate, a specific type of polyalkylene succinimide, and, in one embodiment, a zinc dialkyldithiophosphate.

The present invention also involves a particular embodiment useful for medium speed diesel engines that are susceptible to water contamination.

Prior to discussing the invention in further detail, the following terms will be defined:

Definitions

As used herein, the following terms have the following meanings, unless expressly stated to the contrary:

The term "medium-speed diesel engine" refers to a diesel engine having an engine speed of about 300–1,200 rpm, corresponding to a cylinder bore size range of about 200–640 mm.

The term "Base Number" or "BN" refers to the amount of base equivalent to milligrams of KOH in one gram of sample. Thus, higher BN numbers reflect more alkaline products, and therefore a greater alkalinity reserve. The BN of a sample can be determined by ASTM Test No. D2896 or any other equivalent procedure.

The term "overbased detergent" refers to a composition comprising a diluent (e.g., lubricating oil) and a detergent complex wherein additional alkalinity is provided by a stoichiometric excess of a metal base, based on the amount required to react with the acidic moiety of the detergent. Enough diluent should be incorporated in the overbased detergent to ensure easy handling at safe operating temperatures.

The term "highly overbased detergent" refers to an overbased detergent having a BN of from 225 to 350, or more.

The term "hydrocarbyl" denotes an organic radical composed of carbon and hydrogen, which may be aliphatic, alicyclic, aromatic or combinations thereof, e.g. aralkyl.

The term "hydrocarbyl phenol" means a phenol group having one or more hydrocarbyl substituents; at least one of which has a sufficient number of carbon atoms to impart oil solubility to the phenol.

The term "alkaline earth metal" means calcium, barium, magnesium, and strontium.

The term "alkaline earth hydrocarbyl phenate" means an alkaline earth metal salt of a hydrocarbyl phenol.

The term "phenate-carboxylate" refers to an alkaline earth metal hydrocarbyl phenate modified by incorporation of a carboxylic acid, dicarboxylic acid, polycarboxylic acid, or anhydride, acid chloride or ester thereof.

The term "phenate-stearate" refers to an alkaline earth metal hydrocarbyl phenate modified by incorporation of a stearic acid.

The term "succinimide" is understood in the art to include many of the amide, imide, etc. species that are also formed by the reaction of a succinic anhydride with an amine. The predominant product, however, is succinimide and this term has been generally accepted as meaning the product of a reaction of an alkenyl- or alkyl-substituted succinic acid or anhydride with a polyamine. Alkenyl or alkyl succinimides are disclosed in numerous references and are well known in the art.

The term "PIBSA" means polyisobutenyl succinic anhydride.

The term "alkenyl or alkylsuccinic acid derivative" refers to a structure having the formula

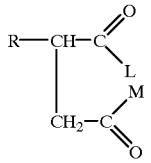

wherein L and M are independently selected from the group consisting of —OH, —Cl, —O—, lower alkyl or taken together are —O— to form an alkenyl or alkylsuccinic anhydride group.

The term "unsaturated acidic reagent" refers to maleic or fumaric reactants of the general formula:

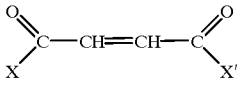

wherein X and X' are the same or different, provided that at least one of X and X' is a group that is capable of reacting to esterify alcohols, form amides, or amine salts with ammonia or amines, form metal salts with reactive metals or basically reacting metal compounds and otherwise function as acylating agents. Typically, X and/or X' is —OH, —O-hydrocarbyl, —-$OM^+$ where $M^+$ represents one equivalent of a metal, ammonium or amine cation, —$NH_2$, —Cl, —Br, and taken together X and X' can be —O— so as to form an anhydride. Preferably, X and X' are such that both carboxylic functions can enter into acylation reactions. Maleic anhydride is a preferred unsaturated acidic reactant. Other suitable unsaturated acidic reactants include electron-deficient olefins such as monophenyl maleic anhydride; monomethyl, dimethyl, monochloro, monobromo, monofluoro, dichloro and difluoro maleic anhydride, N-phenyl maleimide and other substituted maleimides; isomaleimides; fumaric acid, maleic acid, alkyl hydrogen maleates and fumarates, dialkyl fumarates and maleates, fumaronilic acids and maleanic acids; and maleonitrile, and fumaronitrile.

Unless otherwise specified, all percentages are in weight percent and all molecular weights are number average molecular weights (Mn).

Base Oil of Lubricating Viscosity

The base oil of lubricating viscosity used in such compositions may be mineral oil or synthetic oils of viscosity suitable for use in the crankcase of medium speed diesel engines. The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of both monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acids and mono and dihydroxy alkanols can also be used.

Blends of synthetic oils and blends of mineral oils with synthetic oils or synthetic oil blends are also useful. For example, blends of 10% to 25% hydrogenated 1-trimer with 75% to 90% mineral oil gives an excellent lubricating oil base.

Highly Overbased Hydrocarbyl Phenate-carboxylate

The lubricating oil compositions of the present invention comprise from 1% to 30% of an oil-soluble sulfurized alkaline earth metal hydrocarbyl phenate modified by incorporation of from 2% to 40% of at least one of the following:

(1) carboxylic acid or anhydride, acid chloride or ester thereof;

(2) dicarboxylic acid or anhydride, acid chloride or ester thereof; and (3) polycarboxylic acid or anhydride, acid chloride or ester thereof.

That modified alkaline earth metal hydrocarbyl phenate is overbased to have a BN of at least 225 milligrams of KOH/gram.

As shown above, in the definitions section, an "alkaline earth metal hydrocarbyl phenate" means a calcium, barium, magnesium, and strontium salt of a phenol group having one or more organic radical composed of carbon and hydrogen, wherein at least one of the organic radicals has a sufficient number of carbon atoms to impart oil solubility to the phenate. The organic radical may be aliphatic, alicyclic, aromatic or combinations thereof, e.g. aralkyl hydrocarbyl substituents.

Preferably, the alkaline earth metal is calcium or magnesium. Most preferably, the alkaline earth metal is calcium.

Preferably, the organic radical composed of carbon and hydrogen (the hydrocarbyl substituent) is an aliphatic group, more preferably it is an alkyl group, most preferably is an alkyl group having from 9 to 20 carbon atoms.

That alkaline earth metal hydrocarbyl phenate is modified by incorporation of from 2% to 40% of carboxylic acid, dicarboxylic acid, polycarboxylic acid, or anhydride, acid chloride or ester thereof, and the modified phenate is overbased to have a BN of from 225 to 350, or more. Such modified alkaline earth metal hydrocarbyl phenates are taught in U.S. Pat. Nos. 5,714,443; 5,716,914; and 5,728,657.

If a carboxylic acid or anhydride, acid chloride or ester thereof is used, the carboxylic acid should preferably have the formula RCH(R')COOH, where R is a $C_{10}$ to $C_{24}$ alkyl or alkenyl group and R' is either hydrogen, a $C_1$ to $C_4$ alkyl group or a —$CH_2$—COOH group. If a dicarboxylic or polycarboxylic acid, or anhydride, acid chloride or ester thereof is used, the dicarboxylic or polycarboxylic acid should preferably have from 36 to 100 carbon atoms.

Preferably, that alkaline earth metal hydrocarbyl phenate is modified by incorporation of from 12% to 22% of a carboxylic acid. Most preferably, the alkaline earth metal hydrocarbyl phenate is modified with stearic acid.

Preferably, the oil-soluble sulfurized alkaline earth metal hydrocarbyl phenate is a produced by the process disclosed in U.S. Pat. No. 5,728,657, which issued on Mar. 17, 1998. In that process, a mixture having a sulfurized phenate, a metal stearate (such as calcium stearate), at least one solvent, calcium hydroxide, and water is overbased by contacting the mixture with carbon dioxide in the presence of an alkyl polyhydric alcohol. Throughout the overbasing step, the level of agitation is sufficiently high so that all solids are suspended over the length of the overbasing step. After the overbasing step, the overbased mixture is stripped to produce an overbased phenate stearate having less than 0.10 vol. % fine sediments.

Preferably, the polyhydric alcohol to water ratio is maintained sufficiently high so that the ratio is at least 4:1 at the end of the overbasing step. More preferably, the polyhydric alcohol to water ratio is maintained sufficiently high so that the ratio is at least 9:1 at the end of the overbasing step. Preferably, the overbased phenate stearate has less than 0.05 vol. % fine sediments.

The alkyl group of the alcohol has from one to five carbon atoms. Preferably, the alkyl polyhydric alcohol is ethylene glycol.

The sulfurized phenate to be overbased can comprise a partially overbased sulfurized phenate.

Polyalkylene Succinimide

The lubricating oil compositions of the present invention comprise from 0.1% to 5% of a polyalkylene succinimide that can be prepared by contacting the desired alkyl or alkenyl succinic acid derivative with an unsaturated acidic reagent copolymer and polyamine under reactive conditions:

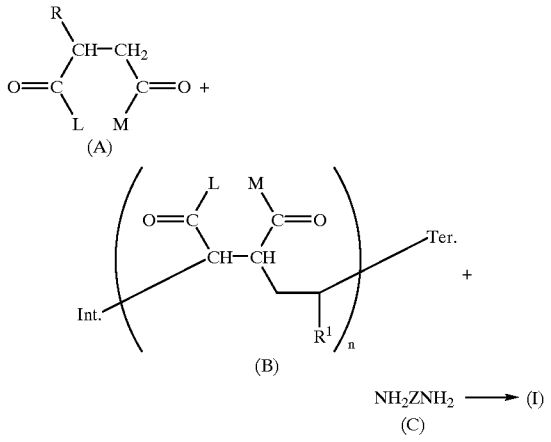

wherein

R is a polyalkyl or polyalkylene having a molecular weight of at least 1000;

$R^1$ is hydrogen, alkyl having from 6 to 40 carbon atoms, cycloalkyl, aryl, alkylaryl, vinyl, alkoxy, or alkylcarboxy;

Z is a polyalkylene polyamine linking radical;

n is a whole integer of from 1 to 3;

Int. is an initiating radical; and

Ter. is a terminating group.

L and M are independently selected from the group consisting of —OH, —Cl, —O—, lower alkyl or taken together are —O— to form an alkenyl or alkylsuccinic anhydride group.

Typically the above process is conducted by contacting from 1.5 to 10 equivalents of alkenyl or alkylsuccinic acid derivative (A) per mole of unsaturated acidic reagent copolymer (B) and from 0.4 to 1.0 equivalents of amine (C) per equivalent of alkenyl or alkylsuccinic acid derivative (A) plus unsaturated acidic reagent copolymer (B). In one preferred embodiment, there are from 0.4 to 0.6 equivalents of amine (C) per equivalent of alkenyl or alkylsuccinic acid derivative (A) plus unsaturated acidic reagent copolymer (B) to produce a bissuccinimide. In conducting this reaction, we have generally found it convenient to first add the alkenyl or alkylsuccinic acid derivative and the unsaturated acidic reagent copolymer together and then add the polyamine. It may be desirable to conduct the reaction in an inert organic solvent. Optimum solvents will vary with the particular copolymer and can be determined from literature sources or routine experimentation. For example, in the case of maleic anhydride poly $\alpha$-olefin copolymers, we found that 100N diluent oil and mixtures of $C_9$ aromatic solvents are acceptable solvents.

We have found that when less than 1.5 equivalents of alkenyl or alkylsuccinic acid derivative (A) per mole of unsaturated acidic reagent copolymer (B) are used then the polymer sometimes contains gels, which is undesirable.

Typically, the reaction is conducted at temperatures in the range of about from 140° to 180° C., preferably 150° to 170° C. for about from one to ten hours, preferably four to six hours. Typically the reaction is conducted at about atmospheric pressure; however, higher or lower pressures can also be used depending on the reaction temperature desired and the boiling point of the reactants or solvent.

Water, present in the system or generated by the reaction of the amine with the succinic or maleic anhydride moieties of (A) and (B) alkyl succinimide, is preferably removed from the reaction system during the course of the reaction via azeotroping or distillation. After reaction completion, the system can be stripped at elevated temperatures (typically 100° C. to 250° C.) and reduced pressures to remove any volatile components which may be present in the product.

The preparation of such an polyalkylene succinimide is disclosed U.S. Pat. No. 5,716,912.

The Alkenyl or Alkylsuccinic Acid Derivatives—Reactant (A)

Alkyl and alkenylsuccinic acid derivatives having a calculated succinic ratio of about from 1:1 to 2.5:1, and preferably about from 1:1 to 1.5:1, may be used in the present process. More preferably, the alkyl or alkenyl succinic acid derivatives have a succination ratio of about from 1:1 to 1.2:1. Most preferably, alkyl or alkenylsuccinic anhydrides are used. Accordingly we prefer to use alkenyl succinic anhydride prepared by the thermal process, both because the calculated succination ratio of material prepared by this process is typically 1.0 to 1.2, and because the produce is essentially chlorine-free because chlorine is not used in the synthesis.

The thermal reaction of a polyolefin with maleic anhydride is well known and is described, for example, in U.S. Pat. No. 3,361,673. The less desirable is the chlorination process characterized by the reaction of a chlorinated polyolefin, with maleic anhydride, which is also well known and is described, for example, in U.S. Pat. No. 3,172,189. Various modifications of the thermal process and chlorination process are also well known, some of which are described in U.S. Pat. Nos. 4,388,471; 4,450,281; 3,018,250 and 3,024,195. Free radical procedures for preparing alkenyl succinic anhydrides are, for example, described in U.S. Pat. Nos. 5,286,799 and 5,319,030.

In accordance with the invention, the alkenyl or alkyl succinic anhydride reactant is derived from a polyolefin having a Mn from 1000 to 5000 and a Mw/Mn ratio of 1:1 to 5:1. In a preferred embodiment, the alkenyl or alkyl group of the succinimide has a Mn value from 1800 to 3000. Most preferred are alkenyl or alkyl substituents having a Mn of from 2000 to 2400.

Suitable polyolefin polymers for reaction with maleic anhydride include polymers comprising a major amount of $C_2$ to $C_5$ monoolefin, e.g., ethylene, propylene, butylene, iso-butylene, and pentene. The polymers can be homopolymers, such as polyisobutylene, as well as copolymers of two or more such olefins, such as copolymers of ethylene and propylene, butylene, and isobutylene, etc. Other copolymers include those in which a minor amount of the copolymer monomers (e.g., 1 to 20 mole percent), is a $C_4$ to $C_8$ nonconjugated diolefin, e.g., a copolymer of isobutylene and butadiene or a copolymer of ethylene, propylene and 1,4-hexadiene, etc.

A particularly preferred class of olefin polymers for reaction with maleic anhydride comprises the polybutenes, which are prepared by polymerization of one or more of 1-butene, 2-butene and isobutene. Preferably, the polybutenes have a number average molecular weight of from 2000 to 2400. Especially desirable are polybutenes containing a substantial proportion of units derived from isobutene. The polybutene may contain minor amounts of butadiene, which may or may not be incorporated in the polymer. These polybutenes are readily available commercial materials well known to those skilled in the art. Examples of procedures illustrating the preparation of such material can be found, for example, in U.S. Pat. Nos. 3,215,707; 3,231,587; 3,515,669; 3,579,450; 3,912,764 and 4,605,808.

The alkenyl or alkylsuccinic anhydride may also be prepared using the so-called highly reactive or high methyl vinylidene polyalkylene, most commonly polyisobutene, such as described in U.S. Pat. Nos. 4,152,499; 5,071,919; 5,137,980; 5,286,823; 5,254,649; published International Applications Numbers WO 93 24539-A1; WO 9310063-A1; and published European Patent Applications Numbers 0355895-A; 0565285A; and 0587381A, all of which are hereby incorporated by reference in their entirety. Other polyalkenes can also be used including, for example, polyalkenes prepared using metallocene catalysts such as for example described in published German patent application DE 4313088A1.

The Unsaturated Acidic Reagent Copolymer—Reactant (B)

The unsaturated acidic reagent copolymers used in the present invention can be random copolymers or alternating copolymers, and can be prepared by known procedures. Further, in most instances, examples of each class are readily commercially available. Such copolymers may be prepared by the free radical reaction of an unsaturated acidic reagent with the corresponding monomer of the other unit of the copolymer. Thus, in the present case, the monomer will correspond to $R^1$ in formula (I) plus a vinyl group, i.e., $R^1$—CH=$CH_2$. Hence, where $R^1$ is phenyl the monomer will be styrene. Accordingly, the unsaturated acidic reagent copolymer can be prepared by the free radical reaction of an unsaturated acidic reagent, preferably maleic anhydride, with the corresponding $C_8$ to $C_{48}$ 1-olefin, $C_8$ to $C_{28}$ polyalkylene, ethylene, styrene, 1,3-butadiene, $C_{3+}$ vinyl alkyl ether, or $C_{4+}$ vinyl alkanoate.

We prefer to use alpha olefins from $C_{12}$ to $C_{28}$ because these materials are commercially readily available, and because they offer a desirable balance of the length of the molecular weight tail, and the solubiltiy of the copolymer in non polar solvents. Mixtures of olefins, e.g. $C_{14}$, $C_{16}$, and $C_{18}$ are especially desirable.

The degree of polymerization of the copolymers can vary over a wide range. In general copolymers of high molecular weight can be produced at low temperatures and copolymers of low molecular weight can be produced at high temperatures. It has been generally shown that for the polymers of this invention, we prefer low molecular weight copolymers, i.e., low molecular weight (2000–4800 for example) because higher molecular weight copolymers (greater than 10,000 for example) can sometimes produce polymers that contain gels.

The copolymerization is conducted in the presence of a suitable free radical initiator; typically a peroxide type initiator, e.g. di(t-butyl) peroxide dicumyl peroxide or azo type initiator, e.g., isobutyinitrile type initiators. Procedures for preparing poly α-olefin copolymers are, for example, described in U.S. Pat. Nos. 3,560,455 and 4,240,916, hereby incorporated by reference in their entirety. Both patents also describe a variety of initiators.

Some examples of maleic anhydride 1-olefin copolymers are:

Poly(styrene-co-maleic anhydride) resins: These materials are known as SMA® resins. There are two molecular weight versions. The low molecular weight resin is called SMA resin and is available from ARCO Chemical with styrene to maleic anhydride ratio's of 1:1, 2:1, and 3:1. The high molecular weight resin is produced by Monsanto (Lytron®), ARCO (Dylark®) or American Cyanamide (Cypress®). Other names for SMA copolymers are Styrolmol, Maron MS, and Provimal ST resins. In some cases partially esterified resins are also available.

Poly(ethylene-co-maleic anhydride) resins: These materials are manufactured by Monsanto under the trade name EMA®. They are also called Malethamer and Vinac resins.

Poly(alpha olefin-co-maleic anhydride) resins are available from Chevron Chemical as PA-18 (octadecene-1-co-maleic anhydride), or can be prepared as in Preparation 1. Alternately mixtures of alpha olefins can be used. These materials have been described in U.S. Pat. Nos. 3,461,108; 3,560,455; 3,560,456; 3,560,457; 3,580,893; 3,706,704; 3,729,450; and 3,729,451. Partially esterified olefin co maleic anhydride resins can also be used. Some examples of these types of resins are called Ketjenlube® resins available from AKZO Co.

Poly(isobutene-co-maleic anhydride) resins are called ISOBAM® and are manufactured by Curaray Co. Ltd. They are also available from Humphrey Chemical Co. under the code K-66.

Poly(butadiene-so-maleic anhydride) resins are called Maldene® and are made by Borg-Warner Corp.

Poly(methylvinylether-co-maleic anhydride) resins are sold by GAF Corporation under the name Gantrey An. Other names are called Visco Frey.

Poly(vinylacetate-co-maleic anhydride) resins are available from Monsanto and are called Lytron 897, 898, and 899. They are also called Pouimalya resins in Europe.

We have found that excellent results can be obtained using a copolymer prepared by the free radical polymerization of maleic anhydride and $C_{12}$ to $C_{18}$ 1-olefins or olefin mixtures thereof.

The Polyamine Reactant (C)

The polyamine reactant should have at least three amine nitrogen atoms per mole, and preferably 4 to 12 amine nitrogens per molecule. Most preferred are polyamines having from about 6 to about 10 nitrogen atoms per molecule. The number of amine nitrogen atoms per molecule of polyamine is calculated as follows:

$$\text{Average number of nitrogen atoms in molecule of polyamine} = \frac{\%N \times M_{pa}}{14 \times 100}$$

wherein

% N=percent nitrogen in polyamine or polyamine mixture $M_{pa}$=number average molecular weight of the polyamine or polyamine mixture Preferred polyalkylene polyamines also contain from about 4 to about 20 carbon atoms, there being preferably from 2 to 3 carbon atoms per alkylene unit. The polyamine preferably has a carbon-to-nitrogen ratio of from 1:1 to 10:1.

Examples of suitable polyamines that can be used to form the compounds of this invention include the following: tetraethylene pentamine, pentaethylene hexamine, Dow E-100® heavy polyamine (number average MW=303, available from Dow Chemical Company, Midland, Mich.), and Union Carbide HPA-X heavy polyamine (number average MW=275, available from Union Carbide Corporation, Danbury, Conn.). Such amines encompass isomers, such as branched-chain polyamines, and the previously mentioned substituted polyamines, including hydrocarbyl-substituted polyamines. HPA-X heavy polyamine ("HPA-X") contains an average of approximately 6.5 amine nitrogen atoms per molecule. Such heavy polyamines generally afford excellent results.

The polyamine reactant may be a single compound but typically will be a mixture of compounds reflecting commercial polyamines. Typically the commercial polyamine will be a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetramine ("TETA"), substituted piperazines and pentaethylene hexamine, but the composition will be largely tetraethylene pentamine and the empirical formula of the total amine composition will closely approximate that of tetraethylene pentamine.

Other examples of suitable polyamines include admixtures of amines of various sizes, provided that the overall mixture contains at least 4 nitrogen atoms per molecule. Included within these suitable polyamines are mixtures of diethylene triamine ("DETA") and heavy polyamine. A preferred polyamine admixture reactant is a mixture containing 20% by weight DETA and 80% by weight HPA-X; as determined by the method described above, this preferred polyamine reactant contains an average of about 5.2 nitrogen atoms per mole.

Methods of preparation of polyamines and their reactions are detailed in Sidgewick's THE ORGANIC CHEMISTRY OF NITROGEN, Clarendon Press, Oxford, 1966; Noller's CHEMISTRY OF ORGANIC COMPOUNDS, Saunders, Philadelphia, 2nd Ed., 1957; and Kirk-Othmer's ENCYCLOPEDIA OF CHEMICAL TECHNOLOGY, 2nd Ed., especially Volumes 2, pp. 99–116.

Post-Treatments

We have found that the dispersancy of the present polymers is generally further improved by reaction with a cyclic carbonate. The resulting modified polymer has one or more nitrogens of the polyamino moiety substituted with a hydroxy hydrocarbyl oxycarbonyl, a hydroxy poly (oxyalkylene) oxycarbonyl, a hydroxyalkylene, hydroxyalkylenepoly-(oxyalkylene), or mixture thereof.

The cyclic carbonate post-treatment is conducted under conditions sufficient to cause reaction of the cyclic carbonate with secondary amino group of the polyamino substituents. Typically, the reaction is conducted at temperatures of about from 0° to 250° C. preferably about from 100° to 200° C. Generally, best results are obtained at temperatures of about from 150° to 180° C.

The reaction may be conducted neat, wherein both the polymer and the cyclic carbonate are combined in the proper ratio, either alone or in the presence of a catalyst (such as an acidic, basic or Lewis acid catalyst). Depending on the viscosity of the polymer reactant, it may be desirable to conduct the reaction using an inert organic solvent or diluent, for example, toluene, xylene. Examples of suitable catalysts include, for example, phosphoric acid, boron trifluoride, alkyl or aryl sulfonic acid, alkali or alkaline carbonate. Generally, the same solvents or diluents as described above with respect to the preparation for the co-polymer (A) or polymer (I) can also be used in the cyclic carbonate post-treatment.

The reaction of polyamino alkenyl or alkyl succinimides with cyclic carbonates is known in the art and is described in U.S. Pat. No. 4,612,132, hereby incorporated by reference, in its entirety. Generally, the procedures described to post-treat polyamino alkenyl or alkyl succinimides with cyclic carbonates can also be applied to post-treat the present polymers.

A particularly preferred cyclic carbonate is 1,3-dioxolan-2-one (ethylene carbonate) because it affords excellent results and also because it is readily commercially available.

The molar charge of cyclic carbonate employed in the post-treatment reaction is preferably based upon the theoretical number of basic nitrogens contained in the polyamino substituent of the succinimide. Thus, when one equivalent of tetraethylene pentamine ("TEPA") is reacted with one equivalent of succinic anhydride and one equivalent of copolymer, the resulting bis succinimide will theoretically contain 3 basic nitrogens. Accordingly, a molar charge of 2 would require that two moles of cyclic carbonate be added for each basic nitrogen or in this case 6 moles of cyclic carbonate for each mole equivalent of polyalkylene succinimide or succinimide prepared from TEPA. Mole ratios of the cyclic carbonate to the basic amine nitrogen of the polyamino alkenyl succinimide employed in the process of this invention are typically in the range of from about 1:1 to about 4:1; although preferably from about 2:1 to about 3:1.

As described in U.S. Pat. No. 4,612,132, cyclic carbonates may react with the primary and secondary amines of a polyamino alkenyl or alkyl succinimide to form two types of compounds. In the first instance, strong bases, including unhindered amines such as primary amines and some secondary amines, react with an equivalent of cyclic carbonate to produce a carbamic ester. In the second instance, hindered bases, such as hindered secondary amines, may react with an equivalent of the same cyclic carbonate to form a hydroxyalkyleneamine linkage. (Unlike the carbamate products, the hydroxyalkyleneamine products retain their basicity.) Accordingly, the reaction of a cyclic carbonate may yield a mixture of products. When the molar charge of the cyclic carbonate to the basic nitrogen of the succinimide is about 1 or less, a large portion of the primary and secondary amines of the succinimide will be converted to hydroxy hydrocarbyl carbamic esters with some hydroxyhydrocarbylamine derivatives also being formed. As the mole ratio is raised above 1 increased amounts of poly(oxyalkylene) polymers of the carbamic esters and the hydroxyhydrocarbylamine derivatives are produced.

Both the polymers and post-treated polymers of this invention can also be reacted with boric acid or a similar boron compound to form borated dispersants having utility within the scope of this invention. In addition to boric acid (boron acid), examples of suitable boron compounds include boron oxides, boron halides and esters of boric acid. Generally from about 0.1 equivalents to 10 equivalents of boron compound to the modified succinimide may be employed.

In addition to the carbonate and boric acids post-treatments both the compounds may be post-treated, or further post-treatment, with a variety of post-treatments designed to improve or impart different properties. Such post-treatments include those summarized in columns 27–29 of U.S. Pat. No. 5,241,003. Such treatments include, treatment with:

- Inorganic phosphorous acids or anhydrates (e.g., U.S. Pat. Nos. 3,403,102 and 4,648,980);
- Organic phosphorous compounds (e.g., U.S. Pat. No. 3,502,677);
- Phosphorous pentasulfides;
- Boron compounds as already noted above (e.g., U.S. Pat. Nos. 3,178,663 and 4,652,387);
- Carboxylic acid, polycarboxylic acids, anhydrides and/or acid halides (e.g., U.S. Pat. Nos. 3,708,522 and 4,948,386);
- Epoxides polyepoxiates or thioexpoxides (e.g., U.S. Pat. Nos. 3,859,318 and 5,026,495);
- Aldehyde or ketone (e.g., U.S. Pat. No. 3,458,530);
- Carbon disulfide (e.g., U.S. Pat. No. 3,256,185);
- Glycidol (e.g., U.S. Pat. No. 4,617,137);
- Urea, thourea or guanidine (e.g., U.S. Pat. Nos. 3,312,619; 3,865,813; and British Patent GB 1,065,595);
- Organic sulfonic acid (e.g., U.S. Pat. No. 3,189,544 and British Patent GB 2,140,811);
- Alkenyl cyanide (e.g., U.S. Pat. Nos. 3,278,550 and 3,366,569);
- Diketene (e.g., U.S. Pat. No. 3,546,243);
- A diisocyanate (e.g., U.S. Pat. No. 3,573,205);
- Alkane sultone (e.g., U.S. Pat. No. 3,749,695);
- 1,3-Dicarbonyl Compound (e.g., U.S. Pat. No. 4,579,675);
- Sulfate of alkoxylated alcohol or phenol (e.g., U.S. Pat. No. 3,954,639);
- Cyclic lactone (e.g., U.S. Pat. Nos. 4,617,138; 4,645,515; 4,668,246; 4,963,275; and 4,971,711);
- Cyclic carbonate or thiocarbonate linear monocarbonate or polycarbonate, orchloroformate (e.g., U.S. Pat. Nos. 4,612,132; 4,647,390; 4,648,886; 4,670,170);
- Nitrogen-containing carboxylic acid (e.g., U.S. Pat. No. 4,971,598 and British Patent GB 2,140,811);
- Hydroxy-protected chlorodicarbonyloxy compound (e.g., U.S. Pat. No. 4,614,522);
- Lactam, thiolactam, thiolactone or ditholactone (e.g., U.S. Pat. Nos. 4,614,603 and 4,666,460);
- Cyclic carbonate or thiocarbonate, linear monocarbonate or plycarbonate, or chloroformate (e.g., U.S. Pat. Nos. 4,612,132; 4,647,390; 4,646,860; and 4,670,170);
- Nitrogen-containing carboxylic acid (e.g., U.S. Pat. No. 4,971,598 and British Patent GB 2,440,811);

Hydroxy-protected chlorodicarbonyloxy compound (e.g., U.S. Pat. No. 4,614,522);

Lactam, thiolactam, thiolactone or dithiolactone (e.g., U.S. Pat. Nos. 4,614,603, and 4,666,460);

Cyclic carbamate, cyclic thiocarbamate or cyclic dithiocarbamate (e.g., U.S. Pat. Nos. 4,663,062 and 4,666,459);

Hydroxyaliphatic carboxylic acid (e.g., U.S. Pat. Nos. 4,482,464; 4,521,318; 4,713,189);

Oxidizing agent (e.g., U.S. Pat. No. 4,379,064);

Combination of phosphorus pentasulfide and a polyalkylene polyamine (e.g., U.S. Pat. No. 3,185,647);

Combination of carboxylic acid or an aldehyde or ketone and sulfur or sulfur chloride (e.g., U.S. Pat. Nos. 3,390,086; 3,470,098);

Combination of a hydrazine and carbon disulfide (e.g. U.S. Pat. No. 3,519,564);

Combination of an aldehyde and a phenol (e.g., U.S. Pat. Nos. 3,649,229; 5,030,249; 5,039,307);

Combination of an aldehyde and an O-diester of dithiophosphoric acid (e.g., U.S. Pat. No. 3,865,740);

Combination of a hydroxyaliphatic carboxylic acid and a boric acid (e.g., U.S. Pat. No. 4,554,086);

Combination of a hydroxyaliphatic carboxylic acid, then formaldehyde and a phenol (e.g., U.S. Pat. No. 4,636,322);

Combination of a hydroxyaliphatic carboxylic acid and then an aliphatic dicarboxylic acid (e.g., U.S. Pat. No. 4,663,064);

Combination of formaldehyde and a phenol and then glycolic acid (e.g., U.S. Pat. No. 4,699,724);

Combination of a hydroxyaliphatic carboxylic acid or oxalic acid and then a diisocyanate (e.g. U.S. Pat. No. 4,713,191);

Combination of inorganic acid or anhydride of phosphorus or a partial or total sulfur analog thereof and a boron compound (e.g., U.S. Pat. No. 4,857,214);

Combination of an organic diacid then an unsaturated fatty acid and then a nitrosoaromatic amine optionally followed by a boron compound and then a glycolating agent (e.g., U.S. Pat. No. 4,973,412);

Combination of an aldehyde and a triazole (e.g., U.S. Pat. No. 4,963,278);

Combination of an aldehyde and a triazole then a boron compound (e.g., U.S. Pat. No. 4,981,492);

Combination of cyclic lactone and a boron compound (e.g., U.S. Pat. No. 4,963,275 and 4,971,711).

Zinc Dialkyldithiophosphates

Depending upon the type of application used, the lubricating oil composition can further comprise from 0.1% to 2% of at least one zinc dithiophosphate wear-inhibition additive. That zinc dithiophosphate wear-inhibition additive is particularly useful in ships, workboats and stand-by or continuous electrical power generation.

For stand-by or continuous electrical power generation applications, the zinc dithiophosphate wear-inhibition additive can be a zinc dialkyldithiophosphate derived from primary alcohols.

For marine applications, a particular physical mixture of zinc dialkyl-dithiophosphates is preferred because it increases the water tolerance of diesel engines that are susceptible to water contamination. That physical mixture has from 20% to 90% (preferably from 40% to 80%) of a zinc dialkyl-dithiophosphate derived from only primary alkyl alcohols, and from 10% to 80% (preferably from 20% to 60%) of a zinc dialkyl-dithiophosphate derived from only secondary alkyl alcohols.

This physical mixture of zinc dialkyl-dithiophosphates differs from chemical mixtures of zinc dialkyl-dithiophosphates derived from mixtures of different types of alcohols.

The individual zinc dialkyldithiophosphates can be produced from dialkyldithiophosphoric acids of the formula:

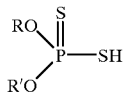

The hydroxy alkyl compounds from which the dialkyldithiophosphoric acids are derived can be represented generically by the formula ROH or R'OH, where R or R' is alkyl or substituted alkyl group. Preferably, R or R' is a branched or non-branched alkyl containing three to twenty carbon atoms; more preferably, a branched or non-branched alkyl containing three to eight carbon atoms.

Mixtures of hydroxy alkyl compounds may also be used. As is recognized in the art, these hydroxy alkyl compounds need not be monohydroxy alkyl compounds. That is, the dialkyldithiophosphoric acids may be prepared from mono-, di-, tri-, tetra-, and other polyhydroxy alkyl compounds, or mixtures of two or more of the foregoing. It is to be understood that most commercially available alcohols are not pure compounds but are mixtures containing a predominant amount of the desired alcohol and minor amounts of various isomers and/or longer or shorter chain alcohols.

Preferably, the zinc dialkyldithiophosphate derived from only primary alkyl alcohols is derived from a single primary alcohol. Preferably, that single primary alcohol is 2-ethylhexanol.

Preferably, the zinc dialkyldithiophosphate derived from only secondary alkyl alcohols is derived from a mixture of secondary alcohols. Preferably, that mixture of secondary alcohols is a mixture of 2-butanol and 4-methyl-2-pentanol.

The phosphorus pentasulfide reactant used in the dialkyldithiophosphoric acid formation step of this invention may contain minor amounts of any one or more of $P_2S_3$, $P_4S_3$, $P_4S_7$, or $P_4S_9$. Such phosphorus sulfide compositions may contain minor amounts of free sulfur.

While the structure of phosphorus pentasulfide is generally represented as $P_2S_5$, the actual structure is believed to contain four phosphorus atoms and ten sulfur atoms, i.e., $P_4S_{10}$. For the purposes of this invention, the phosphorus sulfide reactant will be considered as a compound having the structure of $P_2S_5$ with the understanding that the actual structure is probably $P_4S_{10}$.

Other Additive Components

The following additive components are examples of some components that can be favorably employed in combination with the polyalkylene succinimide and phenate-carboxylate of the present invention in the compositions of the present invention. These examples of additives are provided to illustrate the present invention, but they are not intended to limit it:

1. Other metal detergents: sulfurized or unsulfurized alkyl or alkenyl phenates, alkyl or alkenyl aromatic sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl salicylates, sulfurized or unsulfurized alkyl or alkenyl naphthenates, metal salts of alkanoic acids, metal salts of an alkyl or alkenyl multiacid, and chemical and physical mixtures thereof.

2. Oxidation inhibitors
   (a) Phenol type oxidation inhibitors: 4,4'-methylene bis (2,6-di-tert-butylphenol), 4,4'-bis(2,6-di-tert-butylphenol), 4,4'-bis(2-methyl-6-tert-butylphenol), 2,2'-methylene bis (4-methyl-6-tert-butyl-phenol), 4,4'-butylidenebis(3-methyl-6-tert-butylphenol), 4,4'-isopropyl-idenebis(2,6-di-tert-butylphenol), 2,2'-methylenebis(4-methyl-6-nonylphenol), 2,2'-isobutylidene-bis(4,6-dimethylphenol), 2,2'-methylenebis (4-methyl-6-cyclohexylphenol), 2,6-di-tert-butyl-4-methyl-phenol, 2,6-di-tert-butyl-4-ethylphenol, 2,4-dimethyl-6-tert-butyl-phenol, 2,6-di-tert-4-(N,N' dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis (3,5-di-tert-butyl-4-hydroxybenzyl).
   (b) Diphenylamine type oxidation inhibitor: alkylated diphenylamine, phenyl-α-naphthylamine, and alkylated-α-naphthylamine.
   (c) Other types: metal dithiocarbamate (e.g., zinc dithiocarbamate), and methylenebis (dibutyl-dithiocarbamate).
3. Rust inhibitors (Anti-rust agents)
   (a) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.
   (b) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.
4. Demulsifiers: addition product of alkylphenol and ethyleneoxide, poloxyethylene alkyl ether, and polyoxyethylene sorbitan ester.
5. Extreme pressure agents (EP agents): zinc dialkyldithiophosphate (primary alkyl type & secondary alkyl type), sulfurized oils, diphenyl sulfide, methyl trichlorostearate, chlorinated naphthalene, fluoroalkylpolysiloxane, and lead naphthenate.
6. Friction modifiers: fatty alcohol, fatty acid, amine, borated ester, and other esters.
7. Multifunctional additives: sulfurized oxymolybdenum dithiocarbamate, sulfurized oxymolybdenum organo phosphoro dithioate, oxymolybdenum monoglyceride, amine-molybdenum complex compound, and sulfur-containing molybdenym complex compound.
8. Pour point depressants: polymethyl methacrylate.
9. Foam Inhibitors: alkyl methacrylate polymers and dimethyl silicone polymers.

Engine Lubricating Oil Composition

The present invention comprises a lubricating oil composition suitable for use in medium speed diesel engines, that lubricating oil composition comprises:

(a) a major amount of a base oil of lubricating viscosity;
(b) from 1% to 30% of the modified oil-soluble sulfurized alkaline earth metal hydrocarbyl phenate described above, and
(c) from 0.1% to 5% of the polyalkylene succinimide described above.

That lubricating oil composition can also comprise other additives described above. Preferably, the base number of the lubricating oil composition is from 5 to 70 BN, especially from 5 to 55 BN.

In a further embodiment, an engine lubricating oil composition is produced by blending a mixture of the above components. The lubricating oil composition produced by that method might have a slightly different composition than the initial mixture, because the components may interact. The components can be blended in any order and can be blended as combinations of components.

Lubricating marine engines with the lubricating oil composition of the present invention can increase the water tolerance of those engines if the lubricating oil composition comprises the optional element of a particular physical mixture of zinc dialkyldithiophosphates, as described above.

Additive Concentrates

Additive concentrates are also included within the scope of this invention. The concentrates of this invention comprise the polyalkylene succinimide and the phenate-carboxylate described above, preferably with at least one other additive, as disclosed above. The concentrates contain sufficient organic diluent to make them easy to handle during shipping and storage.

From 20% to 80% of the concentrate is organic diluent. Suitable organic diluents which can be used include mineral oil or synthetic oils, as described above in the section entitled "Base Oil of Lubricating Viscosity."

Examples of Additive Packages

Below are representative examples of additive packages that can be used in a variety of applications. These representative examples employ the polyalkylene succinimide and phenate-carboxylate of the present invention. Those compounds may be used either with or without other metal-containing detergents, depending upon the desired BN of the final product. The following percentages are based on the amount of active component, with neither process oil nor diluent oil. These examples are provided to illustrate the present invention, but they are not intended to limit it.

| | | |
|---|---|---|
| 1) | Phenate-carboxylate | 60% |
| | Polyalkylene succinimide | 5% |
| | Primary alkyl zinc dithiophosphate | 5% |
| | Oil of lubricating viscosity | 30% |
| 2) | Phenate-carboxylate | 60% |
| | Polyalkylene succinimide | 5% |
| | Phenol type oxidation inhibitor | 10% |
| | Oil of lubricating viscosity | 25% |
| 3) | Phenate-carboxylate | 50% |
| | Polyalkylene succinimide | 5% |
| | Alkylated diphenylamine-type oxidation inhibitor | 15% |
| | Oil of lubricating viscosity | 30% |
| 4) | Phenate-carboxylate | 50% |
| | Polyalkylene succinimide | 5% |
| | Phenol-type oxidation inhibitor | 5% |
| | Alkylated diphenylamine-type oxidation inhibitor | 5% |
| | Oil of lubricating viscosity | 25% |

EXAMPLES

The invention will be further illustrated by following examples, which set forth particularly advantageous method embodiments. While the Examples are provided to illustrate the present invention, they are not intended to limit it.

The Formulations:

Formulation I: A formulation of the present invention was prepared comprising:

1. a base oil of lubricating viscosity;
2. an oil-soluble sulfurized calcium alkylphenate-stearate;
3. 2.33% polyalkylene succinimide prepared by
   (a) reacting under reactive conditions a mixture of:
      (1) an alkenyl or alkylsuccinic acid derivative,
      (2) an unsaturated acidic reagent copolymer of an unsaturated acidic reagent and an olefin, and
      (3) a polyamine having at least three nitrogen atoms and from 4 to 20 carbon atoms; and
   (b) post-treating the reaction product of step (a) with ethylene carbonate;
4. a zinc dialkyldithiophosphate derived from primary alcohols.
5. a commercial diphenylamine anti-oxidant (Irganox L57).
6. a poly-siloxane [silicone] foam inhibitor to prevent excessive crankcase foaming.

The finished formulation had a base number of 40.

Formulations A–C: Formulations A, B, and C were prepared using the same base oil of lubricating viscosity, zinc dialkyldithiophosphate, diphenylamine anti-oxidant, and poly-siloxane foam inhibitor, but with the following modifications.

In Formulation A, the specific polyalkylene succinimide was substituted with 2.00% of a conventional succinimide derived from 950 Mn polybutenes and post-treated with ethylene carbonate.

In Formulation B, the oil-soluble sulfurized calcium alkylphenate modified by incorporation of stearic acid was substituted with an unmodified oil-soluble sulfurized calcium alkylphenate.

In Formulation C, the specific polyalkylene succinimide was substituted with 2.00% of the conventional succinimide derived from 950 Mn polybutenes and post-treated with ethylene carbonate, and the oil-soluble sulfurized calcium alkylphenate modified by incorporation of stearic acid was substituted with an unmodified oil-soluble sulfurized calcium alkylphenate.

The Tests

Modified IP-48 Oxidation Test: The test consists of an oxidative and a thermal part. In the oxidative part heated air is blown through the oil, while in the thermal part nitrogen is used. At the end of the test, the viscosities and base numbers are determined on the samples after nitrogen and air blowing. This allows one to calculate the viscosity increase and BN depletion due to oxidation only (excluding the thermal effect).

Coke Bottle Hydrolytic Stability Test: An oil/water mixture is put in a coke bottle. The coke bottle is continuously rotated for an extended period of time at high temperatures. Then, the water in the sample is evaporated by blowing heated nitrogen through the oil/water mixture. When the sample is dry, it is filtered to determine the amount of deposits. Also the BN of the dried oil is determined to calculate the BN retention relative to the fresh oil and the calcium carbonate phase is determined using IR (normally amorphous, but if the oil is not hydrolytically stable the calcium carbonate is crystalline).

The Results

The results of those tests for the above-identified formulations are given below:

| Formulation | I | A | B | C |
|---|---|---|---|---|
| Modified IP 48 Oxidation Test | | | | |
| BN depletion | 19.2 | 25.1 | 39.3 | 41.4 |
| Visc.increase | 6.6 | 14.0 | 28.0 | 31.0 |
| MAO 29 Coke Bottle Hydrolytic Stability | | | | |
| $CaCO_3$ Crystallization, IR Absorbance | 0.00 | 0.43 | 0.31 | 0.62 |
| % Deposits | 0.00 | 1.15 | 0.49 | 2.55 |
| % BN Retention | 92.1 | 76.8 | 72.8 | 38.9 |

Effect of Physical Mixtures of Zinc Dithiophosphates

The following table shows the advantage of using physical mixtures of zinc dithiophosphates (both derived from primary alcohols and from secondary alcohols) instead of using zinc dithiophosphates derived solely from primary alcohols or secondary alcohols. That table shows the results of a Centrifuge Water Tolerance test and the ASTM D1401 Water/Oil Separability Test for various combinations of primary and secondary zinc dialkyldithiophosphates in conventional marine oil. The primary zinc dialkyldithiophosphate was a zinc dialkyldithiophosphate derived from 2-ethylhexanol. The secondary zinc dialkyldithiophosphate was a mixture of 69% 2-butanol and 31% 4-methyl2-pentanol.

In the Centrifuge Water Tolerance (CWT) test, a set amount of oil is cycled through a centrifuge and water is injected at a set rate into that oil at the feed of a centrifuge. After a set time, the centrifuge is stopped and the amount of deposits is measured in grams. The smaller the weight of deposits, the better the oil was at tolerating water. The ASTM D1401 Water/Oil Separability Test is an industry standard test for how easily the water separates from oil, measured in mililiters (ml) of water. The higher the ml of water, the better the water/oil separation.

| Ratio (Primary/Secondary) | 100/0 | 80/20 | 60/40 | 40/60 | 20/80 | 0/100 |
|---|---|---|---|---|---|---|
| CWT, grams | 40 | 33 | 37 | 38 | 45 | 54 |
| D1401, ml. | 34 | 36 | 37 | 5 | 0 | 0 |

The above table shows that physical mixtures of 80/20, 60/40, and 40/60 primary/secondary zinc dialkyldithiophosphates have better water tolerance than either the primary or secondary zinc dialkyldithiophosphate alone. The above table also shows that physical mixtures of 80/20 and 60/40 primary/secondary zinc dialkyldithiophosphates have better water/oil separation than either the primary or secondary zinc dialkyldithiophosphate alone.

While the present invention has been described with reference to specific embodiments, this application is intended to cover those various changes and substitutions that may be made by those skilled in the art without departing from the spirit and scope of the appended claims.

What is claimed is:

1. A lubricating oil composition suitable for use in medium speed diesel engines, wherein said lubricating oil composition comprises:

(a) a major amount of a base oil of lubricating viscosity;

(b) from 1% to 30% of an oil-soluble sulfurized alkaline earth metal hydrocarbyl phenate modified by incorporation of from 2% to 40% of at least one of the following:

(1) carboxylic acid or anhydride, acid chloride or ester thereof;

(2) dicarboxylic acid or anhydride, acid chloride or ester thereof; and (3) polycarboxylic acid or anhydride, acid chloride or ester thereof;

wherein said modified alkaline earth metal hydrocarbyl phenate has a BN of at least 225 milligrams of KOH/gram; and (c) from 0.1% to 5% of a polyalkylene succinimide prepared by reacting a mixture under reactive conditions, wherein the mixture comprises:

(1) an alkenyl or alkylsuccinic acid derivative;

(2) an unsaturated acidic reagent copolymer of an unsaturated acidic reagent and an olefin; and (3) a polyamine.

2. A lubricating oil composition according to claim 1 wherein said modified alkaline earth metal hydrocarbyl phenate is an oil-soluble sulfurized calcium alkylphenate modified by incorporation of from 12% to 22% of carboxylic acid, wherein the alkyl group has from 9 to 20 carbon atoms.

3. A lubricating oil composition according to claim 2 wherein said carboxylic acid is stearic acid.

4. A lubricating oil composition according to claim 1 wherein the alkenyl or alkyl substituent of said alkenyl or alkylsuccinic acid derivative has a Mn of from 1800 to 3000, wherein said unsaturated acidic reagent is maleic anhydride, wherein said olefin has an average of from 12 to 28 carbon atoms, wherein said copolymer has a Mn of from 2000 to 4800, and wherein said polyamine has at least three nitrogen atoms and from 4 to 20 carbon atoms.

5. A lubricating oil composition according to claim 4 wherein said alkenyl or alkylsuccinic acid derivative is derived from polybutenes having a number average molecular weight of from 2000 to 2400, and wherein said mixture contains from 0.4 to 0.6 equivalents of said polyamine per equivalent of alkenyl or alkylsuccinic acid derivative plus unsaturated acidic reagent copolymer.

6. A lubricating oil composition according to claim 4, wherein said polyalkylene succinimide is treated with a cyclic carbonate or a linear mono- or poly-carbonate under reactive conditions.

7. A lubricating oil composition according to claim 4 wherein said cyclic carbonate is ethylene carbonate.

8. A lubricating oil composition according to claim 1 further comprising from 0.1% to 2% of at least one zinc dithiophosphate wear-inhibition additive.

9. A lubricating oil composition according to claim 8 wherein said zinc dithiophosphate wear-inhibition additive is a zinc dialkyldithiophosphate derived from primary alcohols.

10. A lubricating oil composition according to claim 8 wherein said zinc dithiophosphate wear-inhibition additive is a physical mixture of:

(a) from 20% to 90% of a zinc dialkyldithiophosphate derived from only primary alkyl alcohols, and (b) from 10% to 80% of a zinc dialkyldithiophosphate derived from only secondary alkyl alcohols.

11. A lubricating oil composition according to claim 10 wherein said wear-inhibition additive is a physical mixture of:

(a) from 40% to 80% of a zinc dialkyldithiophosphate derived from only primary alkyl alcohols, and (b) from 20% to 60% of a zinc dialkyldithiophosphate derived from only secondary alkyl alcohols;

wherein all of the alkyl groups of all the zinc dialkyldithiophosphates have from three to twenty carbon atoms.

12. A lubricating oil composition according to claim 11 wherein said wear-inhibition additive is a physical mixture of:

(a) from 40% to 80% of a zinc dialkyldithiophosphate derived from 2-ethylhexanol, and (b) from 20% to 60% of a zinc dialkyldithiophosphate derived from a mixture of 2-butanol and 4-methyl-2-pentanol.

13. A method for reducing the effects of oxidation in a medium speed diesel engine, said method comprising lubricating said medium speed diesel engine with the lubricating oil composition according to claim 1.

14. A method for increasing the water tolerance of a medium speed diesel engine that are susceptible to water contamination, said method comprising lubricating said medium speed diesel engine with the lubricating oil composition according to claim 10.

15. A concentrate comprising:

(a) from 20% to 80% of a diluent;

(b) an oil-soluble sulfurized alkaline earth metal hydrocarbyl phenate modified by incorporation of from 2% to 40% of at least one of the following:

(1) carboxylic acid or anhydride, acid chloride or ester thereof;

(2) dicarboxylic acid or anhydride, acid chloride or ester thereof; and (3) polycarboxylic acid or anhydride, acid chloride or ester thereof;

wherein said modified alkaline earth metal hydrocarbyl phenate has a BN of at least 225 milligrams of KOH/gram; and (c) a polyalkylene succinimide prepared by reacting a mixture under reactive conditions, wherein the mixture comprises:

(1) an alkenyl or alkylsuccinic acid derivative;

(2) an unsaturated acidic reagent copolymer of an unsaturated acidic reagent and an olefin; and (3) a polyamine.

16. A process for producing a lubricating oil composition comprising blending a mixture comprising:

(a) a major amount of a base oil of lubricating viscosity;

(b) from 1% to 30% of an oil-soluble sulfurized alkaline earth metal hydrocarbyl phenate modified by incorporation of from 2% to 40% of at least one of the following:

(1) carboxylic acid or anhydride, acid chloride or ester thereof;

(2) dicarboxylic acid or anhydride, acid chloride or ester thereof; and (3) polycarboxylic acid or anhydride, acid chloride or ester thereof;

wherein said modified alkaline earth metal hydrocarbyl phenate has a BN of at least 225 milligrams of KOH/gram; and (c) from 0.1% to 5% of a polyalkylene succinimide prepared by reacting a mixture under reactive conditions, wherein the mixture comprises:

(1) an alkenyl or alkylsuccinic acid derivative;

(2) an unsaturated acidic reagent copolymer of an unsaturated acidic reagent and an olefin; and (3) a polyamine.

17. A lubricating oil composition produced by the process according to claim 16.

* * * * *